US009389570B1

(12) United States Patent
Miyakoshi

(10) Patent No.: US 9,389,570 B1
(45) Date of Patent: Jul. 12, 2016

(54) IMAGE FORMING APPARATUS AND FIXING DEVICE INCLUDING A PRESSING MEMBER THAT APPLIES PRESSURE TO A TONER IMAGE

(71) Applicant: FUJI XEROX CO., LTD., Tokyo (JP)

(72) Inventor: Yukiko Miyakoshi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/809,369

(22) Filed: Jul. 27, 2015

(30) Foreign Application Priority Data

Jan. 22, 2015 (JP) ..... 2015-010204

(51) Int. Cl.
*G03G 15/20* (2006.01)
*G03G 15/00* (2006.01)

(52) U.S. Cl.
CPC ..... *G03G 15/6585* (2013.01); *G03G 15/2064* (2013.01)

(58) Field of Classification Search
CPC ..... G03G 15/6585; G03G 15/2064
USPC ..... 399/67
See application file for complete search history.

(56) References Cited

U.S. PATENT DOCUMENTS

| | | | | |
|---|---|---|---|---|
| 6,983,119 | B2 | 1/2006 | Nakayama | |
| 8,750,739 | B2 | 6/2014 | Tamaki et al. | |
| 2007/0154230 | A1* | 7/2007 | Choi | G03G 15/2039 399/69 |
| 2010/0119247 | A1* | 5/2010 | Seol | G03G 15/206 399/67 |

FOREIGN PATENT DOCUMENTS

| | | | |
|---|---|---|---|
| JP | 2001-255764 A | | 9/2001 |
| JP | 2003241561 A | * | 8/2003 |
| JP | 2004-184476 A | | 7/2004 |
| JP | 2013-044838 A | | 3/2013 |

* cited by examiner

*Primary Examiner* — Susan Lee
(74) *Attorney, Agent, or Firm* — Sughrue Mion, PLLC

(57) ABSTRACT

An image forming apparatus includes a toner-image-forming device that forms a toner image on a recording material with a toner having a volume-mean particle size of about 6 μm or smaller; and a fixing device that includes a fixing member that fixes the toner image, a pressing member that applies pressure to the toner image, and a heating member that heats the fixing member. The pressing member applies a first pressure to the toner image while the recording material carrying the toner image passes through a pressing portion by taking a first passing time period in a first state. The pressing member applies a second pressure lower than the first pressure to the toner image while the recording material carrying the toner image passes through the pressing portion by taking a second passing time period longer than the first passing time period in a second state.

8 Claims, 4 Drawing Sheets

FIG. 3

| | | WORKING EXAMPLE 1 | WORKING EXAMPLE 2 | WORKING EXAMPLE 3 | COMPARATIVE EXAMPLE 1 | COMPARATIVE EXAMPLE 2 | COMPARATIVE EXAMPLE 3 | COMPARATIVE EXAMPLE 4 |
|---|---|---|---|---|---|---|---|---|
| TONER PARTICLE SIZE (μm) | | 3 | 4 | 6 | 3 | 4 | 6 | 7 |
| NORMAL MODE | PRESSING FORCE ($kgf/cm^2$) | 6 | 6 | 6 | 6 | 6 | 6 | 6 |
| | HEATING TIME (s) | 0.02 | 0.02 | 0.02 | 0.02 | 0.02 | 0.02 | 0.02 |
| | GLOSS (%) | 51 | 53 | 58 | 51 | 53 | 58 | 60 |
| | FIXABILITY | A | A | A | A | A | A | A |
| | OFFSET | A | A | A | A | A | A | A |
| LOW-GLOSS MODE | PRESSING FORCE ($kgf/cm^2$) | 1 | 1 | 1 | 1 | 1 | 1 | 1 |
| | HEATING TIME (s) | 0.04 | 0.04 | 0.04 | 0.02 | 0.02 | 0.02 | 0.04 |
| | GLOSS (%) | 35 | 35 | 38 | — | — | — | — |
| | FIXABILITY | A | A | A | B | B | B | A |
| | OFFSET | A | A | A | A | A | A | B |

IMAGE FORMING APPARATUS AND FIXING DEVICE INCLUDING A PRESSING MEMBER THAT APPLIES PRESSURE TO A TONER IMAGE

CROSS-REFERENCE TO RELATED APPLICATIONS

This application is based on and claims priority under 35 USC 119 from Japanese Patent Application No. 2015-010204 filed Jan. 22, 2015.

BACKGROUND (i) Technical Field

The present invention relates to an image forming apparatus and a fixing device.

(ii) Related Art

Related-art technologies include a fixing device that applies heat and pressure to recording material carrying a toner image in a pressing portion provided between a fixing member and a pressing member so that the toner image is fixed to the recording material, and an image forming apparatus including such a fixing device. In such an image forming apparatus, the gloss given to the image formed on the recording material is controlled by, for example, changing conditions such as the pressure to be applied to the recording material in the pressing portion.

SUMMARY

According to an aspect of the invention, there is provided an image forming apparatus including a toner-image-forming device that forms a toner image on a recording material with a toner having a volume-mean particle size of about 6 μm or smaller; and a fixing device that includes a fixing member that fixes the toner image to the recording material, a pressing member that applies pressure to the toner image at a pressing portion through which the recording material carrying the toner image passes, and a heating member that heats the fixing member. The pressing member applies a first pressure to the toner image while the recording material carrying the toner image passes through the pressing portion by taking a first passing time period in a first state. The pressing member applies a second pressure to the toner image while the recording material carrying the toner image passes through the pressing portion by taking a second passing time period in a second state. The second pressure is lower than the first pressure applied in the pressing portion. The second passing time period is longer than the first passing time period.

BRIEF DESCRIPTION OF THE DRAWINGS

An exemplary embodiment of the present invention will be described in detail based on the following figures, wherein:

FIG. 3 is a table summarizing the particle size of a toner, fixing conditions, and the results of evaluations for each of Working Examples 1 to 3 and Comparative Examples 1 to 4.

DETAILED DESCRIPTION

Overall Configuration of Image Forming Apparatus

Figure 1:
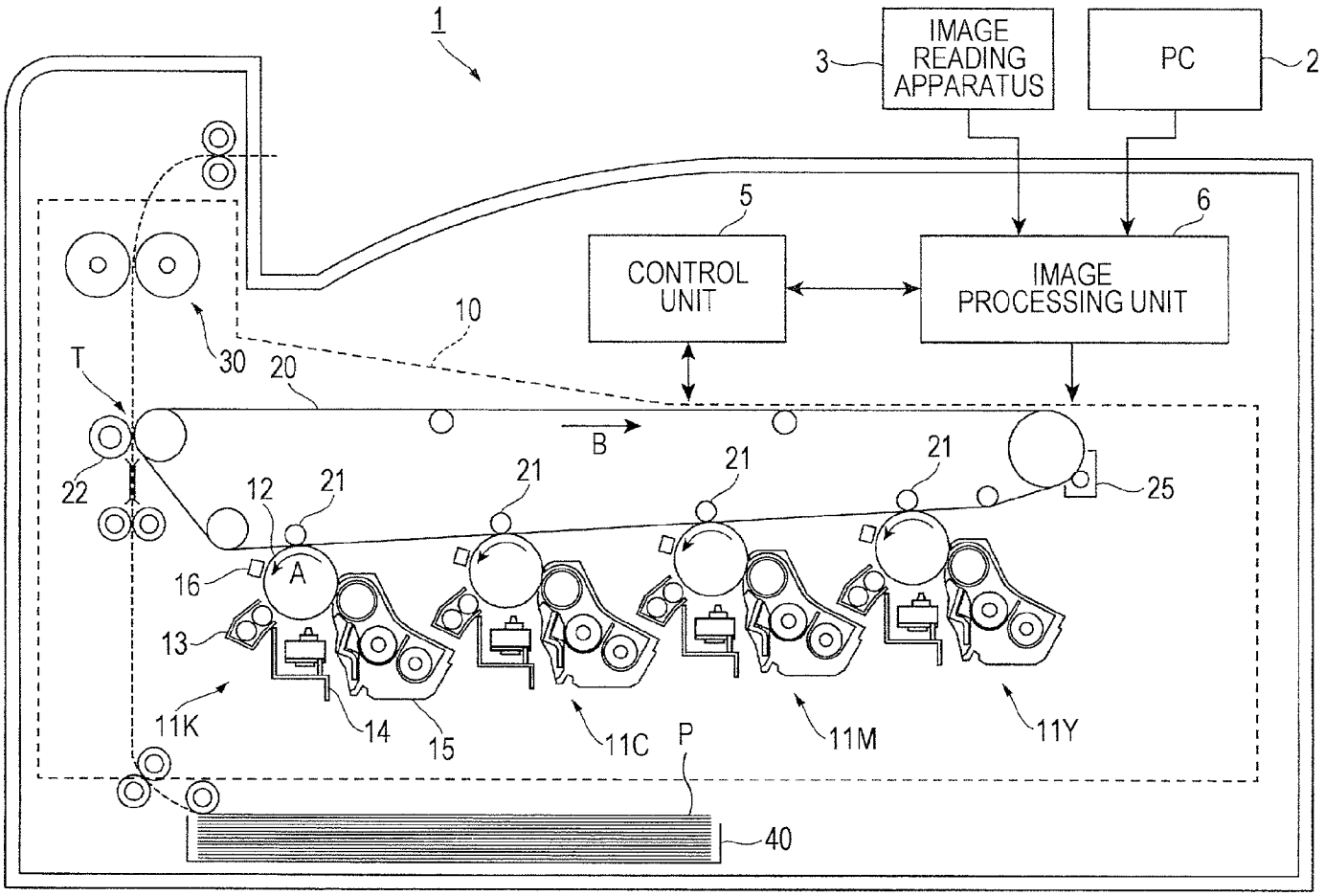
FIG. 1 illustrates an overall configuration of an image forming apparatus according to the exemplary embodiment.

FIG. 1 illustrates an overall configuration of an image forming apparatus 1 according to an exemplary embodiment of the present invention.

The image forming apparatus 1 is a so-called tandem-type image forming apparatus. The image forming apparatus 1 includes an image forming section 10 that forms an image on the basis of pieces of image data for different colors, a control unit 5 as an exemplary controller that controls the entire operation of the image forming apparatus 1, and a sheet holder 40 that holds sheets P to be supplied to the image forming section 10. The image forming apparatus 1 further includes an image processing unit 6 that performs a predetermined processing operation on image data transmitted thereto from, for example, a personal computer (PC) 2 or an image reading apparatus 3.

The image forming section 10 includes four image forming units 11Y, 11M, 11C, and 11K (hereinafter also collectively referred to as "image forming units 11") as exemplary toner-image-forming devices that are arranged in parallel at a predetermined interval. The image forming units 11 each include a photoconductor drum 12 on which an electrostatic latent image to be developed into a toner image is to be formed, a charging device 13 that charges the surface of the photoconductor drum 12 with a predetermined potential, a light-emitting-diode (LED) printhead 14 that exposes the photoconductor drum 12 charged by the charging device 13 to light emitted therefrom on the basis of a corresponding one of pieces of image data for different colors, a developing device 15 that develops the electrostatic latent image on the photoconductor drum 12 into a toner image, and a drum cleaner 16 that cleans the surface of the photoconductor drum 12 after the transfer.

The image forming units 11 all have the same configuration, except toners contained in the respective developing devices 15. The image forming units 11 form toner images in yellow (Y), magenta (M), cyan (C), and black (K), respectively.

The image forming section 10 further includes an intermediate transfer belt 20 to which the toner images in the respective colors on the respective photoconductor drums 12 of the respective image forming units 11 are transferred in such a manner as to be superposed one on top of another, and first transfer rollers 21 that sequentially transfer the toner images in the respective colors formed by the respective image forming units 11 to the intermediate transfer belt 20 in first transfer. The image forming section 10 further includes a second transfer roller 22 that collectively transfers the toner images in the respective colors superposed on the intermediate transfer belt 20 to a sheet P as an exemplary recording material (recording paper) in second transfer, a belt cleaner 25 that cleans the surface of the intermediate transfer belt 20 after the second transfer, and a fixing device 30 that fixes the superposed toner images transferred to the sheet P in the second transfer to the sheet P. In the image forming apparatus 1 according to the exemplary embodiment, a combination of the intermediate transfer belt 20, the first transfer rollers 21, and the second transfer roller 22 is regarded as a transfer unit.

The image forming apparatus 1 according to the exemplary embodiment performs the following image forming process under the control of the control unit 5. Image data transmitted from the PC 2 or the image reading apparatus 3 to the image forming apparatus 1 is processed in a predetermined manner by the image processing unit 6, whereby pieces of image data for the respective colors are generated. The pieces of image data for the respective colors are transmitted to the respective image forming units 11. Subsequently, for example, in the image forming unit 11K that forms a black (K) toner image, the photoconductor drum 12 rotating in a direction of arrow A is charged with a predetermined potential by the charging device 13. Subsequently, the LED printhead 14 performs scan exposure on the photoconductor drum 12 on the basis of black (K) image data transmitted from the image processing unit 6 to the LED printhead 14, whereby an electrostatic latent image that is to become a black (K) image is formed on the photoconductor drum 12. Then, the electrostatic latent image for the black (K) image on the photoconductor drum 12 is developed into a black (K) toner image by the developing device 15. Likewise, the image forming units 11Y, 11M, and 11C form yellow (Y), magenta (M), and cyan (C) toner images, respectively.

The toner images in the respective colors thus formed on the photoconductor drums 12 of the image forming units 11 are sequentially electrostatically transferred to the intermediate transfer belt 20 in the first transfer by the respective first transfer rollers 21 in such a manner as to be superposed one on top of another while the intermediate transfer belt 20 is rotating in a direction of arrow B, whereby a set of superposed toner images in the respective colors is formed on the intermediate transfer belt 20. With the rotation of the intermediate transfer belt 20, the set of superposed toner images on the intermediate transfer belt 20 is transported to an area where the second transfer roller 22 is provided (a second transfer part T). Synchronously with the transport of the set of superposed toner images to the second transfer part T, a sheet P is fed from the sheet holder 40 to the second transfer part T, where the set of superposed toner images is collectively electrostatically transferred to the sheet P in the second transfer, with a transfer electric field produced by the second transfer roller 22.

Subsequently, the sheet P carrying the set of superposed toner images that has been electrostatically transferred thereto is transported to the fixing device 30. The set of superposed toner images on the sheet P transported to the fixing device 30 is subjected to heat and pressure applied thereto by the fixing device 30, thereby being fixed to the sheet P. The sheet P having the fixed set of superposed toner images is discharged to the outside of the image forming apparatus 1.

Meanwhile, toners remaining on the photoconductor drums 12 after the first transfer (first-transfer residual toners) and toners remaining on the intermediate transfer belt 20 after the second transfer (second-transfer residual toners) are removed by the drum cleaners 16 and by the belt cleaner 25, respectively.

The above image forming process performed by the image forming apparatus 1 is repeated a number of times corresponding to the number of pages to be printed.

The image forming apparatus 1 according to the exemplary embodiment has two modes of image forming operation for forming an image on a sheet P: namely, a normal mode, and a low-gloss mode in which an image with a gloss lower than that obtained in the normal mode is formed. Details of the modes of image forming operation will be described separately below.

The normal mode is selected when the image to be formed is a full-color image or a multi-color image, such as a photograph, desired to have a high gloss. The low-gloss mode is selected when the image to be formed is a monochrome image or a black-and-white image, such as a document image, desired to have a low gloss. The term "multi-color image" refers to an image composed of two or more colors of yellow (Y), magenta (M), cyan (C), and black (K). The term "full-color image" refers to an image composed of all of the colors of yellow (Y), magenta (M), cyan (C), and black (K). The full-color image and the multi-color image are also simply collectively referred to as "color image." The term "monochrome image" refers to an image composed of any one of the colors of yellow (Y), magenta (M), cyan (C), and black (K).

Configuration of Fixing Device

Figure 2:
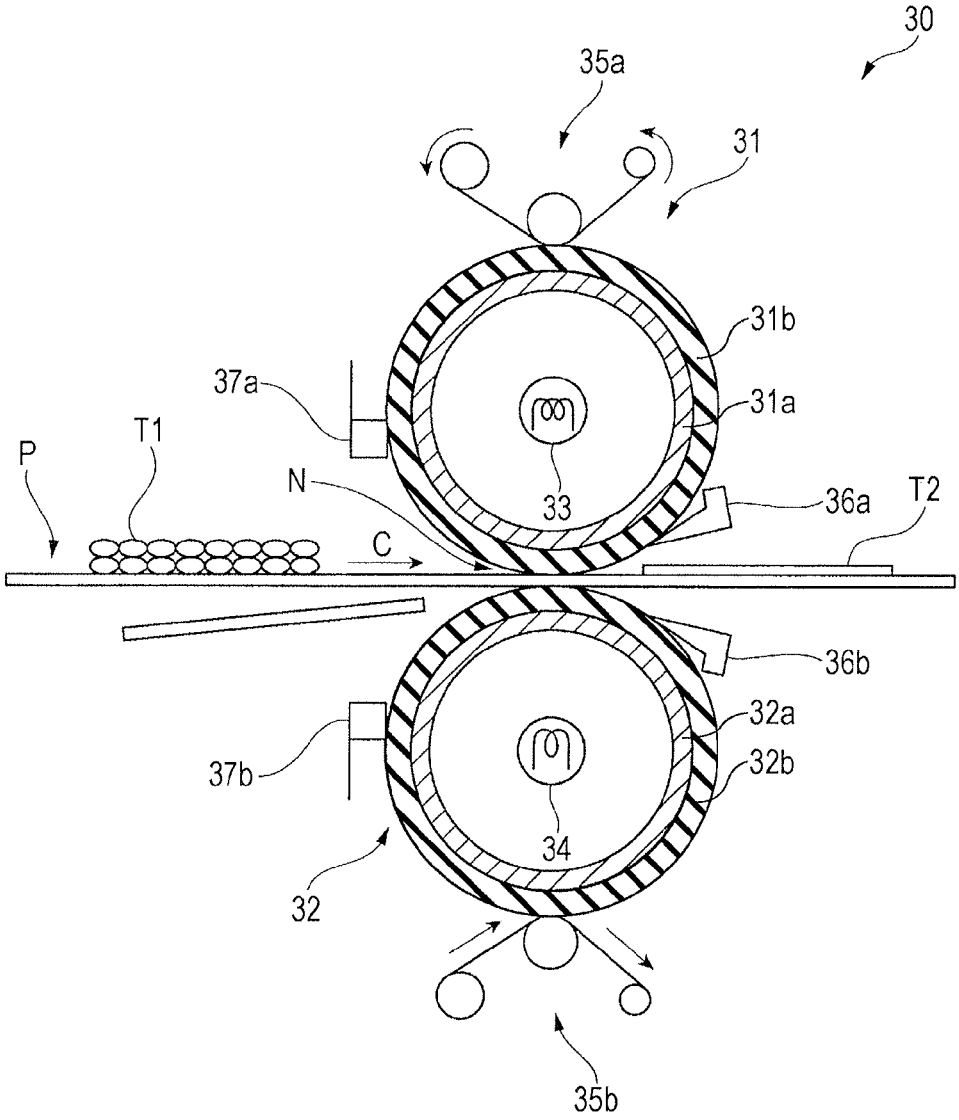
FIG. 2 illustrates a configuration of a fixing device according to the exemplary embodiment.

A configuration of the fixing device 30 according to the exemplary embodiment will now be described. FIG. 2 illustrates the configuration of the fixing device 30 according to the exemplary embodiment.

As illustrated in FIG. 2, the fixing device 30 according to the exemplary embodiment includes a round-cylindrical fixing roller 31 as an exemplary fixing member, and a round-cylindrical pressure roller 32 as an exemplary pressing member. The pressure roller 32 is provided face to face with the fixing roller 31.

The fixing device 30 further includes cleaning webs 35*a* and 35*b* that are provided in contact with the surfaces of the fixing roller 31 and the pressure roller 32, respectively. The cleaning webs 35*a* and 35*b* remove toners and so forth adhered to the fixing roller 31 and the pressure roller 32.

The fixing device 30 further includes releasing wedges 36*a* and 36*b* that help release the sheet P having undergone a fixing process in a fixing nip N, to be described separately below, from the fixing roller 31 and from the pressure roller 32, respectively.

The fixing device 30 further includes temperature sensors 37*a* and 37*b* that are provided in contact with the surfaces of the fixing roller 31 and the pressure roller 32, respectively, and are intended for measurement of the respective temperatures of the fixing roller 31 and the pressure roller 32. The temperature sensors 37*a* and 37*b* are each, for example, a thermistor whose resistance value changes with the temperature.

As illustrated in FIG. 2, the fixing roller 31 includes a round-cylindrical metal core 31*a* made of metal such as stainless steel or iron, and an elastic layer 31*b* provided over the metal core 31*a* and made of a heat-resistant elastic material such as silicone rubber.

A heater 33 as an exemplary heating member that heats the fixing roller 31 is provided on the inner side of the metal core 31*a* of the fixing roller 31.

As illustrated in FIG. 2, the pressure roller 32 includes a round-cylindrical metal core 32*a* made of metal such as stainless steel or iron, and an elastic layer 32*b* provided over the metal core 32*a* and made of a heat-resistant elastic material such as silicone rubber.

A heater 34 that heats the pressure roller 32 is provided on the inner side of the metal core 32*a* of the pressure roller 32.

In the fixing device 30, the metal core 31*a* of the fixing roller 31 is rotatably supported at two longitudinal ends thereof by respective bearing members (not illustrated). Likewise, the metal core 32*a* of the pressure roller 32 is rotatably supported at two longitudinal ends thereof by respective bearing members (not illustrated).

The bearing members provided at the two longitudinal ends of the metal core 32*a* of the pressure roller 32 are urged toward the fixing roller 31 by respective coil springs (not illustrated). Hence, as illustrated in FIG. 2, the fixing nip N as an exemplary pressing portion is provided between the fixing roller 31 and the pressure roller 32 that are pressed against each other.

In the exemplary embodiment, the pressing force (nipping pressure) generated between the fixing roller 31 and the pressure roller 32 in the fixing nip N is changed in accordance with the mode (the normal mode and the low-gloss mode) of image forming operation and other conditions that are set on the image forming apparatus 1. Details of such fixing conditions will be described separately below.

In the exemplary embodiment, the fixing roller 31 receives a driving force from a driving motor (not illustrated) via one of the bearing members, and the fixing roller 31 is rotated in a specific direction (the counterclockwise direction in FIG. 2) at a predetermined speed about an axis extending in the longitudinal direction thereof. The pressure roller 32 that is in contact with the fixing roller 31 rotates in another specific direction (the clockwise direction in FIG. 2) by following the rotation of the fixing roller 31. That is, the pressure roller 32 rotates in conjunction with the fixing roller 31 by receiving a rotational driving force from the fixing roller 31.

The speed of rotation of the fixing roller 31 and the pressure roller 32 is selected from a range of, for example, 50 mm/sec to 300 mm/sec under the control of the control unit 5.

In the exemplary embodiment, the speed of rotation of the fixing roller 31 or the length of the fixing nip N (the nip width) is changed in accordance with the mode (the normal mode or the low-gloss mode) of image forming operation and other conditions that are set on the image forming apparatus 1. Details of such settings will be described separately below. Thus, in the exemplary embodiment, the time elapsed for the sheet P to pass through the fixing nip N, in other words, the period of time for heating the sheet P in the fixing nip N (hereinafter also simply referred to as heating time), is varied.

In the exemplary embodiment, the heater 33 is supported in such a manner as to extend through the metal core 31*a* of the fixing roller 31 and to be spaced apart from the inner circumferential surface of the metal core 31*a* of the fixing roller 31. In the exemplary embodiment, the heater 33 directly faces the metal core 31*a* of the fixing roller 31, so that the fixing roller 31 is directly heated by the heater 33. Likewise, the heater 34 is supported in such a manner as to extend through the metal core 32*a* of the pressure roller 32 and to be spaced apart from the inner circumferential surface of the metal core 32*a* of the pressure roller 32. In the exemplary embodiment, the heater 34 directly faces the metal core 32*a* of the pressure roller 32, so that the pressure roller 32 is directly heated by the heater 34.

The heater 33 and the heater 34 are each, for example, a halogen heater including a filament made of a piece of spirally coiled tungsten wire enclosed in a tube filled with halogen gas.

In the exemplary embodiment, power is supplied to the heater 33 and to the heater 34 under the control of the control unit 5, whereby the heater 33 and the heater 34 generate heat, and the fixing roller 31 and the pressure roller 32 are each heated to a predetermined temperature. Specifically, the control unit 5 controls whether or not to supply power to the heater 33 and to the heater 34 on the basis of the results of detection by the temperature sensors 37*a* and 37*b* and such that the surface temperatures of the fixing roller 31 and the pressure roller 32 each become a predetermined temperature (hereinafter also referred to as fixing temperature). In the exemplary embodiment, the fixing temperature is selected from a range of, for example, 140° C. to 200° C.

In the exemplary embodiment, the fixing temperature is changed in accordance with the mode (the normal mode and the low-gloss mode) of image forming operation and other conditions that are set on the image forming apparatus 1. Details of the settings will be described separately below.

Fixing Operation of Fixing Device

A fixing operation performed by the fixing device 30 according to the exemplary embodiment will now be described.

When an operation of forming a toner image is started in the image forming apparatus 1 (see FIG. 1), power is supplied to the driving motors that drive the heaters 33 and 34 and the fixing roller 31 of the fixing device 30 under the control of the control unit 5. Accordingly, the heater 33 and the heater 34 generate heat, and the fixing roller 31 and the pressure roller 32 are each heated to a predetermined temperature. Furthermore, the fixing roller 31 rotates at a predetermined speed, and the pressure roller 32 also rotates by following the rotation of the fixing roller 31.

In a state where the surfaces of the fixing roller 31 and the pressure roller 32 have each been heated to the predetermined temperature, a sheet P carrying an unfixed set of toner images (denoted by T1 in FIG. 2) is transported in a direction of arrow C and is fed into the fixing nip N provided between the fixing roller 31 and the pressure roller 32. Then, in the fixing nip N, the sheet P and the unfixed set of toner images on the sheet P are heated and pressed between the fixing roller 31 and the pressure roller 32. Consequently, the set of toner images is fixed to the sheet P, whereby a fixed set of toner images (denoted by T2 in FIG. 2) is obtained on the sheet P.

More specifically, the unfixed set of toner images on the sheet P in the fixing nip N is softened and melted by heat applied thereto by the fixing roller 31 and the pressure roller 32. Furthermore, the melted set of toner images is pressed together with the sheet P by the fixing roller 31 and the pressure roller 32, whereby at least part of the toners composing the toner images penetrates into a surface layer of the sheet P. Then, the part of the toners that has penetrated into the surface layer of the sheet P is cooled and solidified, which is called anchor effect. Consequently, the force of adhesion or fixation of the toner images to the sheet P increases, whereby the set of toner images is fixed to the sheet P.

The temperature of the toners composing the set of toner images on the sheet P in the fixing nip N becomes higher from the entrance side toward the exit side of the fixing nip N and highest at the exit of the fixing nip N. The temperature of the toners in the fixing nip N ranges from 100° C. to 150° C., in general.

Subsequently, the sheet P having the fixed set of toner images is released from the fixing roller 31 and the pressure roller 32 with the aid of the releasing wedges 36*a* and 36*b*, and is transported to the outside of the image forming apparatus 1.

Toners Used in Image Forming Apparatus

The image forming units 11 of the image forming apparatus 1 according to the exemplary embodiment each use a toner having a particle size (volume-mean particle size) of 6 μm or about 6 μm or smaller. Using toners each having such a particle size makes the probability that defective fixing or offset of toner images may occur in the fixing device 30 lower than in a case where, for example, toners each having a particle size larger than 6 μm or about 6 μm are used. The term "offset" refers to a phenomenon in which, for example, toners are melted excessively, and part of such melted toners to be fixed to the sheet P is retained on the surface of the fixing roller 31 and is retransferred as a residual image to the sheet P after one revolution of the fixing roller 31. Typical toners have particles sizes of 3 μm or larger.

As to be described separately below, toners that are used in a typical image forming apparatus include color-image toners intended for forming full-color images or multi-color images, and monochrome-image toners intended for forming monochrome images. In the image forming apparatus 1 according to the exemplary embodiment, toners for forming full-color images or multi-color images and toners for forming monochrome images are of the same kind. Specifically, color-image toners are used for both full-color or multi-color images and monochrome images.

The composition of each of the toners having a particle size of 6 μm or about 6 μm or smaller that are used in the image forming apparatus 1 according to the exemplary embodiment is not specifically limited. Toners having typical compositions may be used. For example, a toner that may be used is composed of a binding resin (either crystalline resin or non-crystalline resin) and a colorant (basically, a pigment) with, if necessary, materials such as a releasing agent (oil), a charge controlling agent, a foaming agent, a superplasticizing agent, or a magnetic particles added internally and nonorganic or organic particles added externally.

Modes of Image Forming Operation Available on Image Forming Apparatus 1

In the image forming apparatus 1 according to the exemplary embodiment, the gloss level of an image to be formed on a sheet P is adjusted by controlling the fixing device 30 as follows either in the normal mode or in the low-gloss mode.

Normal Mode

When the image forming apparatus 1 is set to the normal mode as an exemplary first state, conditions for fixing by the fixing device 30 are set as follows under the control of the control unit 5.

When the image forming apparatus 1 is set to the normal mode, the control unit 5 sets the pressure generated in the fixing nip N between the fixing roller 31 and the pressure roller 32 (the nipping pressure) to a predetermined first pressure. Specifically, the pressing force applied to the fixing roller 31 by the pressure roller 32, i.e., the nipping pressure generated in the fixing nip N, is set to a first pressure that is higher than a pressure defined for the low-gloss mode to be described below. The nipping pressure defined for the normal mode (the first pressure) is, for example, 6 kgf/cm$^2$.

Furthermore, when the image forming apparatus 1 is set to the normal mode, the control unit 5 sets the speed of rotation of the fixing roller 31 to a predetermined first speed of rotation. The first speed of rotation of the fixing roller 31 is selected from a range of, for example, 50 mm/sec to 300 mm/sec.

When the fixing roller 31 is rotated at the first speed of rotation, the pressure roller 32 that follows the fixing roller 31 is rotated at the first speed of rotation. Consequently, the time elapsed for the sheet P carrying the toner images to pass through the fixing nip N, i.e., the period of time over which the sheet P carrying the toner images is heated in the fixing nip N, is set to a first heating time (a first passing time period) that is shorter than a heating time (passing time period) defined for the low-gloss mode to be described below. The first heating time defined for the normal mode is, for example, 0.02 seconds.

The heating time is calculated by, for example, dividing the length (mm) of the fixing nip N by the speed (mm/s) of transport of the sheet P.

Furthermore, when the image forming apparatus 1 is set to the normal mode, the control unit 5 sets the target value for the surface temperature of each of the fixing roller 31 and the pressure roller 32 to a predetermined first temperature. In accordance with the first temperature, a predetermined level of power is supplied to the heater 33 and to the heater 34, and the heater 33 and the heater 34 generate heat, whereby the surface temperature (fixing temperature) of each of the fixing roller 31 and the pressure roller 32 in the fixing nip N is brought to the first temperature.

The fixing temperature (the first temperature) in the normal mode is selected from a range of, for example, 140° C. to 200° C.

Low-Gloss Mode

When the image forming apparatus 1 is set to the low-gloss mode as an exemplary second state, the fixing device 30 is set such that the nipping pressure in the fixing nip N is lower and the heating time in the fixing nip N is longer than those defined for the normal mode.

Specifically, when the image forming apparatus 1 is set to the low-gloss mode, the control unit 5 sets the nipping pressure in the fixing nip N to a second pressure that is lower than the first pressure. Thus, the pressing force applied to the fixing roller 31 by the pressure roller 32, i.e., the nipping pressure in the fixing nip N, is changed to the second pressure that is lower than the first pressure defined for the normal mode. The nipping pressure defined for the low-gloss mode (the second pressure) is, for example, 1 kgf/cm$^2$.

Furthermore, when the image forming apparatus 1 is set to the low-gloss mode, the control unit 5 sets the speed of rotation of the fixing roller 31 to a second speed of rotation that is lower than the first speed of rotation defined for the normal mode. Thus, the fixing roller 31 and the pressure roller 32 that follows the fixing roller 31 are each rotated at the second speed of rotation. Consequently, the period of time for heating the sheet P carrying the toner images in the fixing nip N is set to a second heating time (a second passing time period) that is longer than the first heating time defined for the normal mode. The second heating time defined for the low-gloss mode is, for example, 0.04 seconds.

Furthermore, when the image forming apparatus 1 is set to the low-gloss mode, the surface temperature (fixing temperature) of each of the fixing roller 31 and the pressure roller 32 in the fixing nip N may be higher than the first temperature defined for the normal mode.

In the exemplary embodiment, when the image forming apparatus 1 is set to the low-gloss mode, the control unit 5 sets the target value for the surface temperature of each of the fixing roller 31 and the pressure roller 32 to a second temperature that is higher than the first temperature. In accordance with the second temperature, a predetermined level of power is supplied to the heater 33 and to the heater 34, and the heater 33 and the heater 34 generate heat, whereby the surface temperature (fixing temperature) of each of the fixing roller 31 and the pressure roller 32 in the fixing nip N is brought to the second temperature that is higher than the first temperature defined for the normal mode.

As described above, if toners having a particle size (volume-mean particle size) of 6 μm or about 6 μm or smaller are used in the image forming apparatus 1 according to the exemplary embodiment, the fixing device 30 is set such that the heating time in the fixing nip N is made shorter and the nipping pressure generated in the fixing nip N is made lower than in the normal mode. Thus, an image having a gloss lower than in the normal mode is obtained.

The logic of the above setting is as follows.

In general, as the particles size of a toner composing a toner image formed on a sheet becomes larger, the weight of the toner per unit area of the toner image becomes heavier and the thickness of each of toner-particle layers forming the toner image becomes larger. In terms of reducing the amount of toner to be used in the image forming operation, for example, the total thickness of the toner image to be formed on the sheet is often set to a value corresponding to a single toner-particle layer. Hence, the thickness of the toner image to be formed on the sheet depends on the particle size of the toner. Therefore, as the particle size of the toner becomes larger, the thickness of the toner image becomes larger. That is, as the particle size of the toner becomes smaller, the thickness of the toner image becomes smaller.

If the particle size (volume-mean particle size) of the toner is 6 μm or about 6 μm or smaller as in the exemplary embodiment, the weight of the toner per unit area and the thickness of the toner image on the sheet P are smaller than in a case where the particle size of the toner is larger than 6 μm or about 6 μm. Therefore, the heat capacity of the toner image is reduced, and heat is more easily conducted through the toner image in the fixing nip N. Thus, the toner is more easily melted over the entirety from the front side of the toner image to the front side of the sheet P in the fixing nip N than, for example, in the case where the particle size of the toner is larger than 6 μm or about 6 μm.

Hence, in the normal mode, the nipping pressure in the fixing nip N is set to the first pressure that is higher than the first pressure defined for the low-gloss mode. Thus, the surface of the melted toner image is smoothed out when pressed by the fixing roller 31. Consequently, in the normal mode, an image having a gloss higher than in the low-gloss mode is obtained.

On the other hand, in the low-gloss mode, the heating time in the fixing nip N is set to the second heating time that is longer than the first heating time defined for the normal mode, and the nipping pressure in the fixing nip N is set to the second pressure that is lower than the first pressure defined for the normal mode. Hence, the toner is melted more easily in the fixing nip N than in the normal mode. Accordingly, when the sheet P is released from the fixing roller 31 at the exit of the fixing nip N, a very small amount of toner on the surface of the toner image adheres to the fixing roller 31, causing slight offset that is not visible (invisible offset) on the surface of the toner image. Consequently, in the low-gloss mode, the smoothness of the surface of the toner image fixed to the sheet P is reduced, and an image having a gloss that is lower than in the normal mode is obtained.

If the particle size of the toner is larger than 6 μm or about 6 μm, the weight of toner per unit area and the thickness of the toner image on the sheet P increase. Therefore, the heat capacity of the toner image increases, making it difficult for the toner image in the fixing nip N to conduct heat up to a region thereof near the surface of the sheet P.

Hence, to maintain the fixiability of the toner image to the sheet P in the case where the particle size of the toner is larger than 6 μm or about 6 μm, the temperature and the period of time for heating in the fixing nip N need to be increased so that the heat is conducted up to a region of the toner image that is near the surface of the sheet P.

If the temperature and the period of time for heating in the fixing nip N are increased so that the heat is conducted up to a region of the toner image that is near the surface of the sheet P in the case where the particle size of the toner is larger than 6 μm or about 6 μm, the surface of the toner image tends to be melted excessively in a region thereof facing the fixing roller 31.

In the fixing device 30, the sheet P is released from the surface of the fixing roller 31 by utilizing a slipping force (micro-slip) generated when the elastic layer 31*b* of the fixing roller 31 that has been deformed in the fixing nip N restores its original form near the exit of the fixing nip N. If the nipping pressure generated in the fixing nip N is increased, the amount of deformation of the fixing roller 31 (the elastic layer 31*b*) in the fixing nip N increases. Therefore, the amount of micro-slip that occurs near the exit of the fixing nip N increases, making it easier for the sheet P to be released from the fixing roller 31. In other words, if the nipping pressure in the fixing nip N is low, the releasability of the sheet P from the fixing roller 31 tends to be reduced, increasing the probability of the occurrence of offset.

Particularly, in a state where the surface of the toner image on the sheet P is melted excessively in a region thereof facing the fixing roller 31, part of such melted toner tends to adhere to the fixing roller 31. Therefore, if the nipping pressure in the fixing nip N is low, offset tends to occur more often.

Hence, if the nipping pressure is reduced so as to obtain an image having a low gloss in a state where the temperature and the period of time for heating in the fixing nip N are increased so as to maintain the fixability with a particle size of the toner that is larger than 6 μm or about 6 μm, offset tends to occur more often.

In other words, in the case where the particle size of the toner is larger than 6 μm or about 6 μm, it is difficult to obtain an image having a low gloss while both the high fixability of the toner image and a low probability of the occurrence of offset are realized.

As described above, in the image forming apparatus 1 according to the exemplary embodiment, since the nipping pressure in the fixing nip N is made lower and the heating time is made longer in the low-gloss mode than in the normal mode, an image having a lower gloss than in the normal mode is obtained while the occurrence of defective fixing and offset is suppressed.

The above exemplary embodiment concerns a case where the image forming apparatus 1 has two modes of image forming operation of the normal mode and the low-gloss mode that are different in the gloss level of the resulting image. Alternatively, the image forming apparatus 1 may have three or more modes. For example, the image forming apparatus 1 may have three modes of a high-gloss mode for obtaining an image having a high gloss, a low-gloss mode for obtaining an image having a low gloss, and a medium-gloss mode for obtaining an image having a medium gloss that is between the gloss in the high-gloss mode and the gloss in the low-gloss mode.

In such a case, the nipping pressure in the fixing nip N is made lower and the heating time in the fixing nip N is made longer in the medium-gloss mode than in the high-gloss mode, whereas the nipping pressure is made lower and the heating time is made longer in the low-gloss mode than in the high-gloss mode and the medium-gloss mode.

EXAMPLES

The present invention will further be described with examples of the present invention. Note that the present invention is not limited to the following examples.

Working Examples 1 to 3 and Comparative Examples 1 to 4

The following test is conducted by the present inventors. Toners having respective particle sizes (volume-mean particle sizes) of 3 μm, 4 μm, 6 μm, and 7 μm are prepared. The pressing force generated in the fixing nip N between the fixing roller 31 and the pressure roller 32 is set to 6 kgf/cm$^2$ in the normal mode and to 1 kgf/cm$^2$ in the low-gloss mode. Then, the period of time for heating the sheet P in the fixing nip N is varied. Under such conditions, the fixability and the state of offset are evaluated, and the gloss level of the resulting image is measured.

The sheets P used in the test are OS coated paper (basis weight: 127 gsm, smoothness: 4783 sec) manufactured by Fuji Xerox InterField Co., Ltd.

The fixability of the toner image to the sheet P is evaluated in a pencil scratch test conforming to a Japanese Industrial Standard (JIS) K5400. Specifically, solid images formed with the respective toners and under the above conditions are each scratched with pencils having different levels of hardness of 4H to 6B, and whether or not the image is peeled off is checked. The results of the evaluation are classified as follows.

A: The image is peeled off with pencils of HB or harder (there is no problem with the fixability).

B: The image is peeled off with pencils softer than HB (the fixability is insufficient).

The state of offset is evaluated as follows. First, a fixing device 30 not including the cleaning web 35*a* for cleaning the surface of the fixing roller 31 is prepared, and toner images are fixed under different conditions summarized in a table illustrated in FIG. 3 to be referred to below. After the fixing of each of the toner images is complete, a blank sheet with no image is made to pass through the fixing nip N. Then, whether or not there are any toner adhering to the blank sheet is checked. The results of the evaluation are classified as follows.

A: No toner is observed on the sheet P (no offset is observed).

B: Some toner is observed on the sheet P (offset is observed).

Furthermore, the 75-degree gloss of each of the solid images fixed to the sheets P as described above is measured with a micro-gloss measuring instrument manufactured by BYK Gardner (BYK Additives & Instruments).

FIG. 3 is a table summarizing the particle size of the toner, the fixing conditions, and the results of the evaluations for each of Working Examples 1 to 3 and Comparative Examples 1 to 4.

As summarized in FIG. 3, in the low-gloss mode in each of Working Examples 1 to 3, the particle size of the toner is 6 μm or smaller and the pressing force is 1 kgf/cm$^2$. Under such conditions, when the heating time is made longer than in the normal mode in which the pressing force is 6 kgf/cm$^2$, the gloss level of the resulting image and the probability of the occurrence of defective fixing and offset become lower than in the normal mode.

In each of Comparative Examples 1 to 3, as summarized in FIG. 3, the particle size of the toner is 6 μm or smaller. Furthermore, the pressing force is set to 6 kgf/cm$^2$ in the normal mode and to 1 kgf/cm$^2$ in the low-gloss mode. Under such conditions, when the heating time is set to 0.02 seconds in each of the two modes, defective fixing occurs in the low-gloss mode, resulting in insufficient fixability.

In Comparative Example 4, the particle size of the toner is 7 μm as summarized in FIG. 3. Under such conditions, when the nipping pressure in the fixing nip N is set to 1 kgf/cm$^2$, offset occurs. To suppress the occurrence of offset in such a case, the nipping pressure in the fixing nip N needs to be increased. However, if the nipping pressure is increased, the gloss level of the resulting image tends to become high, as described above.

That is, if the toner having a particle size of 7 μm is used, it is difficult to realize both a low probability of the occurrence of offset and a gloss level of the resulting image.

In addition, when P paper instead of OS coated paper is used as the sheet P in the low-gloss mode, not only the gloss level of the resulting image but also the probability of the occurrence of defective fixing and offset become lower than in the normal mode. Detailed description of this result is omitted herein.

Heating Temperature

Subsequently, images are formed under the same conditions defined for Working Example 2 except the fixing temperature, and the gloss level of each of the resulting images is measured. Specifically, the fixing temperature defined for Working Example 2 is gradually increased by predetermined increments, and images are formed at the respective fixing temperatures.

Figure 4:
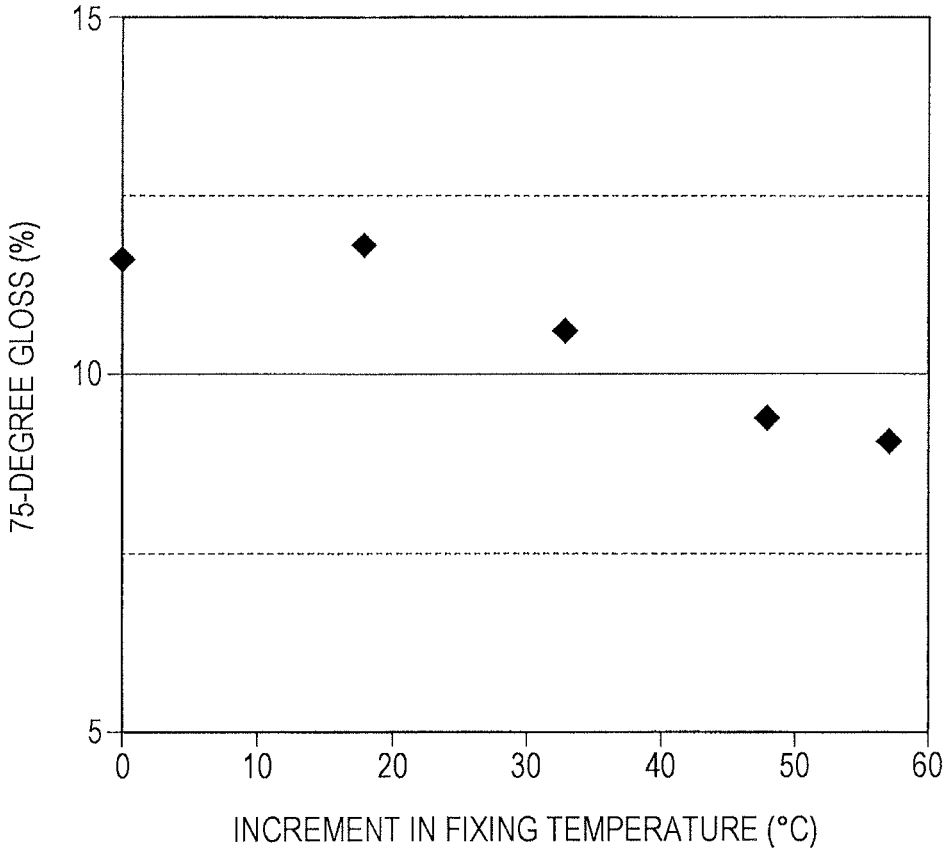
FIG. 4 is a graph illustrating the relationship between the increment by which a fixing temperature defined for Working Example 2 is increased and the gloss level of the resulting image.

FIG. 4 is a graph illustrating the relationship between the increment by which the fixing temperature defined for Working Example 2 is increased and the gloss level of the resulting image.

The graph illustrated in FIG. 4 shows that as the fixing temperature is increased from that defined for Working Example 2, that is, as the fixing temperature of the fixing device 30 becomes higher, the gloss level of the resulting image becomes lower. Hence, if an image having a lower gloss is desired to be formed by the image forming apparatus 1, the low-gloss mode may be selected with a fixing temperature higher than the fixing temperature that is defined for the normal mode.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a toner-image-forming device that forms a toner image on a recording material with a toner having a volume-mean particle size of about 6 μm or smaller; and a fixing device that includes a fixing member that fixes the toner image to the recording material, a pressing member that applies pressure to the toner image at a pressing portion through which the recording material carrying the toner image passes, and a heating member that heats the fixing member, wherein the pressing member applies a first pressure to the toner image while the recording material carrying the toner image passes through the pressing portion by taking a first passing time period in a first state, and the pressing member applies a second pressure to the toner image while the recording material carrying the toner image passes through the pressing portion by taking a second passing time period in a second state, the second pressure being lower than the first pressure applied in the pressing portion, the second passing time period being longer than the first passing time period.

2. The image forming apparatus according to claim 1, wherein the first state is a state in which an image having a predetermined gloss level is obtained, and wherein the second state is a state in which an image having a gloss level that is lower than the gloss level obtained in the first state is obtained.

3. The image forming apparatus according to claim 1, wherein the heating member heats the fixing member with a first temperature in the first state and with a second temperature higher than the first temperature in the second state.

4. The image forming apparatus according to claim 1, wherein, in the second state, the toner image on the recording material is melted in the pressing portion, part of the melted toner image adheres to a surface of the fixing member when the recording material goes out of the pressing portion, and the part of the melted toner image adhered to the surface of the fixing member makes the gloss level of the toner image lower than the gloss level obtained in the first state.

5. The image forming apparatus according to claim 1, wherein the first state is selected when a color image is formed by the toner-image-forming device, and the second state is selected when a monochrome image is formed by the toner-image-forming device.

6. An image forming apparatus comprising:

a toner-image-forming device that forms a toner image on a recording material with a toner having a volume-mean particle size of about 6 μm or smaller; and a fixing device that includes a fixing member that fixes the toner image to the recording material, a pressing member that is pressed against the fixing member with a predetermined pressure and applies pressure to the toner image at a pressing portion through which the recording material carrying the toner image passes, and a heating member that heats the fixing member, wherein, in a case where an image having a gloss level lower than a predetermined gloss level is to be formed, the pressure with which the pressing member is pressed against the fixing member in the pressing portion is reduced and a passing time period that is elapsed for the recording material carrying the toner image to pass through the pressing portion is increased.

7. The image forming apparatus according to claim 6, wherein, in the case where an image having a gloss level lower than the predetermined gloss level is to be formed, a temperature to which the heating member heats the fixing member is raised.

8. A fixing device comprising:

a fixing member that fixes a toner image composed of a toner having a volume-mean particle size of about 6 μm or smaller to a recording material;

a pressing member that applies pressure to the toner image at a pressing portion through which the recording material carrying the toner image passes; and a heating member that heats the fixing member, wherein a state of the fixing device is switchable between a first state in which the recording material carrying the toner image is pressed with a first pressure in the pressing portion and passes through the pressing portion while taking a first passing time period, and a second state in which the recording material carrying the toner image is pressed with a second pressure that is lower than the first pressure in the pressing portion and passes through the pressing portion while taking a second passing time period that is longer than the first passing time period and in which an image having a gloss level that is lower than a gloss level obtained in the first state is obtained.

* * * * *